United States Patent [19]

Alfeis et al.

[11] 4,032,393

[45] June 28, 1977

[54] FIRE RETARDANT WEBS AND INTERNAL TREATMENT THEREFOR

[75] Inventors: Franz J. Alfeis; Raymond W. Goldsmith, both of Lockport, N.Y.

[73] Assignee: The Upson Company, Lockport, N.Y.

[22] Filed: Apr. 5, 1976

[21] Appl. No.: 673,388

[52] U.S. Cl. ..... 162/159; 156/62.2; 156/62.8; 162/181 B; 264/122; 428/302; 428/340; 428/534; 428/920

[51] Int. Cl.[2] ..... D21F 13/00; D21F 13/02; D21J 1/04; D21J 1/16

[58] Field of Search ..... 162/159, 181 B; 428/920, 323, 921, 297, 302, 340, 534; 156/62.2, 62.8; 264/122

[56] References Cited

UNITED STATES PATENTS

| | | | |
|---|---|---|---|
| 1,907,711 | 5/1933 | Becher | 162/159 |
| 2,108,761 | 2/1938 | Becher | 162/159 |
| 2,611,694 | 9/1952 | Becher | 162/159 |
| 3,741,929 | 6/1973 | Burton | 106/15 FP |
| 3,827,997 | 8/1974 | Bergomi | 428/921 |
| 3,895,997 | 7/1975 | Haywood | 162/159 |

*Primary Examiner*—J.C. Cannon
*Attorney, Agent, or Firm*—Cumpston & Shaw

[57] ABSTRACT

Fire retardant cellulosic webs are produced by intimately admixing cellulosic fibers and hydrated aluminum oxide particles and subsequently compressing the admixture to a self-sustaining web. Construction boards are fabricated by laminating a plurality of such webs.

15 Claims, No Drawings

FIRE RETARDANT WEBS AND INTERNAL TREATMENT THEREFOR

BACKGROUND OF THE INVENTION

1. Field of the Invention

The present invention relates to fire retardant cellulosic webs and the internal treatment therefor. More especially, the present invention pertains to the manufacture of construction boards by laminating a plurality of such webs together.

2. Description of the Prior Art

It has long been a major endeavor to produce fire retardant construction materials which exhibit reduced combustion tendencies with respect to both the flash point of the material and the generation of noxious, often toxic, gaseous combustion products. Limited success has been realized by the incorporation of antimony trioxide or various chlorinated hydrocarbons, the latter often times applied in a paint or as a coating for the exterior surfaces of construction paneling. While these fire retardant materials have provided a limited measure of success, it has been found that the antimony trioxide additions significantly increase cost of construction panels incorporating the same. Significantly also, it has been found that the chlorinated hydrocarbons (e.g. chlorinated paraffins) have a marked tendency to decompose during combustion and emit chlorine gas. In order to minimize generation of this toxic product, it has, thus, been mandated that some types of stabilizer additionally be provided.

The plastics industry has similarly been plagued with numerous problems regarding the combustibility of resinous materials. One approach to reduce the combustible tendencies of resinous materials has been the incorporation of an inorganic filler, such as a hydrated oxide, which aids in the reduction of flash point and the generation of noxious or toxic combustion products. That is, such hydrated oxides will absorb heat, thus lowering the overall temperature of the article in which incorporated, and release the water of hydration as innocuous steam. See, for example, U.S. Pat. Nos. 3,741,929 and 3,827,997.

Notwithstanding the apparent success of these prior art techniques to provide a measure of fire retardancy to various materials, the prior art does not recognize analogous treatment of construction boards, most notably cellulosic construction boards, to improve their fire retardant characteristics. In part, this may be attributed to the highly functional nature of uniformity of board caliper and/or waterproofing characteristics versus the interaction between filler additions and degree of compression. Accordingly, the need exists to provide cellulosic construction boards exhibiting improved fire retardancy in a simple, yet highly effective, efficient, and economical manner.

SUMMARY OF THE INVENTION

In accordance with the deficiencies of the prior art, it is the primary object of the present invention to provide a fire retardant cellulosic construction board.

It is also an object of the present invention to provide such a fire retardant construction board manufactured in a simple, yet highly effective, efficient, and economical manner.

A further object of the present invention is to provide fire retardant cellulosic webs, in general, through careful control of additions of hydrated aluminum oxide in concert with a carefully controlled degree of compression whereby the fire retardant characteristics are markedly enhanced.

Yet a further object of the present invention is to provide a precise internal treatment of cellulosic webs resulting from an intimate admixture of cellulosic fibers and hydrated aluminum oxide in a slurry which is suitably formed into a web and subsequently compressed to impart the desired fire retardant charactetistics, without concomitant loss of uniformity of board caliper and/or waterproofing characteristics.

Yet further object and advantages of the present invention will become apparent to the skilled artisan upon examination of the preferred embodiments, taken in conjunction with the appended claims.

In accordance with the present invention, it has now been determined that cellulosic webs and, more especially, cellulosic construction boards, may be treated to markedly enhance their fire retardancy characteristics by intimately admixing cellulosic fibers and hydrated aluminum oxide particles in a pulp slurry, subsequently consolidating the admixture into a self-sustaining web and providing same with a carefully controlled degree of compression.

Also, in accordance with the present invention various operative ranges have been determined. It has been found that the amount of hydrated aluminum oxide may vary between 27% and 36% based upon the weight of the finished web for satisfactory results, while 30 to 33% alumina addition has been found optimum. Similarly, a degree of compression within the range from about 300 to about 700 pounds per linear inch has proved suitable, while 400 to 450 pounds per linear inch is most preferred.

DETAILED DESCRIPTION OF THE INVENTION

The present invention relates to cellulosic webs having improved fire retardant characteristics and, more especially, to construction boards manufactured therefrom. This is a accomplished by precise and careful control of both addition of a quantity of aluminum oxide particles to a pulp slurry stock, in concert with a marked degree of compression. In attempting to provide a construction board exhibiting these improved characteristics, it is imperative to recognize that both the type and quantity of filler as well as degree of compression have significant ramifications upon board caliper and waterproof characteristics, these latter properties being considered highly significant for commercial success. Thus, in order to provide a saleable product, it is necessary to balance both the physical qualities and the fire retardant characteristics thereof. The present invention successfully balances these devices considerations to yield a high quality construction board which also exhibits improved fire retardancy characteristics.

In order to more fully elucidate upon the various objects and advantages of the present invention, the same will be described in terms of various preferred embodiments and illustrated by way of examples, the same intended to be illustrative and in no wise limitative.

The web of the present invention is manufacture following conventional methodologies. Various grades of paper, (scrap or otherwise), or any other suitable pulp source is delivered to a conventional pulper wherein a pulp slurry is established. There are provided the conventional means for filtering non-cellulosic materials, as well as refiners to chop and fiberize the pulp further. To this pulp slurry is added hydrated aluminum oxide particles, having an average particle size of approximately 30 microns, albeit the particle size is not critical to the successful realization of the present invention. In order to reduce losses of the alumina in further processing, there is optionally added a retention aid.

Having thus formed an intimate admixture of cellulosic fibers and hydrated aluminum particles, the slurry is delivered to a thickener where excess water is expressed. From the thickener, the admixture is then deposited on a conventional former and after forming is appropriately heated in order to dry the admixture to yield a self-sustaining web.

After drying, the liner grade webs (i.e., those which will ultimately form one of the faces of the laminated construction board), and the webs to be employed as the filler (i.e., those which will be incorporated within the medial zone of the construction board), are subjected to a marked degree of compression.

Having thus formed the internally treated cellulosic web, fabrication of construction boards proceeds as is typical. The web may be cut into appropriate lengths and widths and thence a plurality of individual webs or sheets laminated to form the finished product.

While the foregoing method for forming the webs of the instant invention may be suitably tailored to meet the needs or desires of individual practices, it is imperative for sucessful realization of the objects and advantages of present invention that the hydrated alumina filler be added within carefully controlled ranges and that the degree of compression be likewise maintained. Deviation from the prescribed limits will not properly balances the numerous considerations of fire retardancy versus a structurally sound and aesthetically pleasing article. For example, the incorporation of excess quantities of alumina filler has been found to result in the inability to maintain uniformity of board caliper as well as a diminution in waterproofing characteristics. Similarly, deviation from the prescribed limits of compression has been found to diminish the synergistic relationship, with too little compression considerably reducing the optimum fire retardant characteristics of the web.

The skilled artisan will also appreciate that, while the present invention is described in terms of additions of hydrated aluminum oxide, other suitable hydrated oxides exist. The most favored fire retardant filler of hydrated aluminum oxide has been chosen due to the fact that it is relatively inexpensive as compared with other fire retardant compounds, tht is is non-toxic and effectively non-polluting, and that it exhibits a marked degree of chemical stability both for purposes of processing and under combustion conditions.

To demonstrate the improved characteristics of construction boards manufactured in accordance with the present invention, the following examples are given as illustrative and not limitative.

EXAMPLE 1

Five laminated construction boards were prepared in accordance with standard production methodology. A first board (I) remained untreated and exhibited a density of 32.7 pounds per cubic foot; a second board (II) was prepared with 30% aluminum oxide but was not compressed, and exhibited a density of 38.4 pounds per cubic foot; a third board (III) was prepared without aluminum oxide additions but was given a normal calendar (300-700pound per linear inch) to yield a density of 35.08 lbs. per cubic foot; a fourth board (IV) was highly calendered (1400 pounds per linear inch) to yield a density of 41.6 pounds per cubic foot, but again contained no hydrated alumina; a fifth board (V) was prepared with 30% hydrated aluminum oxide additions and calendered to yield a density of 51.29 pounds per cubic foot. Each of these boards were tested in accordance with ASTM:D-777-46 Vertical Burn Tests. As the Boards I-V exhibited somewhat different thicknesses, the burning rate obtained in seconds for each board from this test was divided by the caliper to normalize the data. The following results are therefore quoted in terms of seconds per point:

| Board | Results |
|---|---|
| I | 0.961 seconds per point |
| II | 1.378 seconds per point |
| III | 1.077 seconds per point |
| IV | 1.350 seconds per point |
| V | 2.027 seconds per point |

The highly superior and unexpected results observed may be attributed to the combined action of compression and hydrated alumina additions, the sample having been treated in accordance with the present invention clearly superior to those which were not. Significantly, the data also illustrate that substantial departure from the preferred range of compression does not, alone, provide material increase in the fire retardant characteristics of the web. Comparison of the data regarding the tests of Boards III and IV, the latter having received a degree of compression twice the upper limit of the preferred range, indicates an increase of but 25%. Accordingly, only upon the addition of the alumina particles in concert with compression, are the synergistic results manifested.

Table 1 sets forth a percentage comparison of the boards of the Example, wherein a negative figure indicates that the sample in the column has a slower burning rate than that compared in the row; while a positive percentage indicates a slowe burning rate is exhibited by the sample in the row as compared with that in the column.

Summarizing the data of the foregoing tests, the following becomes evident:

1. Addition of hydrated alumina alone decreases the burning rate by about 44%;
2. addition of calendering alone (normal calendering) decreases the burning rate by about 12%;
3. addition of calendering alone (high compression) decreases the burning rate by about 40%, and,
4. addition of both hydrated aluminum oxide and calendering decreases the burning rate by about 110%.

From the foregoing tests, it has been found that the preferred range of hydrated aluminum oxide, based on the weight of the total sheet, is within the range from about 27% to about 36%.

TABLE 1

| | Uncalendered & Untreated | Normal Calendering & Untreated | High Calendering & Untreated | Uncalendered & Treated | High Calendering & Treated |
|---|---|---|---|---|---|
| Uncalendered | | | | | |

TABLE 1-continued

| | Uncalendered & Untreated | Normal Calendering & Untreated | High Calendering & Untreated | Uncalendered & Treated | High Calendering & Treated |
|---|---|---|---|---|---|
| and Untreated | — | − 12.07% | − 40.48% | − 43.39% | − 110.93% |
| Normal Calendering and Untreated | + 12.07% | — | − 25.35% | − 27.95% | − 88.21% |
| High Calendering and Untreated | + 40.48% | + 25.35% | — | − 2.07% | − 50.15% |
| Uncalendered and Treated | + 43.39% | + 27.95% | +2.07% | — | −47.10% |
| High Calendering and Treated | + 110.93% | + 88.21% | +50.15% | +47.10% | — |

Most preferred, however, is the addition of hydrated aluminum oxide within the range from about 30% to about 33% for optimum results. Corresponding to these ranges, it has been determined that the preferred degree of compression is one which yields an ultimate density of the web of from 38 to about 52 pounds per cubic inch (normally about 300 to about 700 pounds per linear inch); while the most preferred degree of compression is one which yields an ultimate density of from about 42 to about 46 pounds per cubic foot (normally 400 to about 450 pounds per linear inch).

Quality control tests were performed on construction boards made in accordance with the present invention and comparisons made with standard stock productions. Handsheets were made with 30% alumina additions and compressed to yield an increase in density of about 34%. These treated and compressed handsheets were compared with untreated controls for mullen and tensile strength: the results indicated minimal degradation in quality as the result of the internal treatment. These handsheets were similarly inspected to determine the effects on waterproofing or sizing characteristics: again the treated samples passed standard sizing specifications. Accordingly, not only does the internal treatment of the present invention provide superior and unexpected increases in fire retardancy characteristics, it does so with minimal sacrifice of other physical properties.

While the invention has now been described in terms of various preferred embodiments and ranges, and has been illustrated with reference to numerous examples, the skilled artisan will appreciate that various other modifications, changes, substitutions, and omissions, may be made without departing from the spirit thereof. Accordingly, it is intended that the invention be limited solely by the scope of the following claims.

What is claimed is:

1. A process for the internal treatment of cellulosic webs to impart improved fire retardancy thereto, comprising the steps of:

a. admixing cellulosic fibers and an effective quantity of a fire-retardant filler of hydrated aluminum oxide particles;

b. consolidating the admixture into a self-sustaining web comprises of a physical admixture of discrete aluminum oxide particles and cellulosic fibers; and., c. compressing said web to impart improved fire retardancy characteristics thereto;

wherein said hydrated aluminum oxide particles are added to be present in the range of from about 27% to about 36% based upon the weight of said web, and wherein the compressing step provides a force of from about 300 to about 700 pounds per linear inch to yield an ultimate density of said web in the range of from about 38 to about 52 pounds per cubic foot.

2. The process of claim 1, wherein said admixture is formed as a batch in a pulper wherein said aluminum oxide particles are added to a pulp slurry of said cellulosic fibers.

3. The process of claim 2, further comprising:

a. refining said admixture to chop and fiberize said pulp;

b. thickening said admixture to remove water from said slurry;

c. depositing said admixture on a web-forming device; and d. drying said admixture to form a self-sustaining web of said cellulosic fibers intimately admixed with said aluminum oxide particles.

4. The process of claim 3, further including the step of calendering said web during said compressing step.

5. The process of claim 2, wherein said aluminum oxide particles are added to be present in a range of from about 30% to about 33% based upon the weight of said web.

6. The process of claim 2, wherein said compressing step provides a force of from about 400 to about 450 pounds per linear inch to yield an ultimate density of said web within the range of from about 42 to about 46 pounds per cubic foot.

7. The process of claim 2, wherein said aluminum oxide particles are added to be present in the range of from about 30% to about 33% based upon the weight of said web, and wherein said compressing step provides a force of from about 400 to about 450 pounds per linear inch to yield an ultimate density of said web within the range of from about 42 to about 46 pounds per cubic foot.

8. The process of claim 1, further comprising the step of laminating a plurality of said webs to form a construction board.

9. A cellulosic web having improved fire retardancy characteristics comprised of a compressed, intimate physical admixture of discrete cellulosic fibers and an effective quantity of discrete fire-retardant hydrated aluminum oxide particles, wherein said aluminum oxide particles comprise from about 27% to about 36% of the weight of the web, said web having a density in the range of from about 38 to about 52 pounds per cubic foot.

10. The web of claim 9, wherein said aluminum oxide particles comprise from about 30% to about 33% of the weight of said web.

11. The web of claim 9, wherein said admixture has been compressed to a density within the range of from about 42 to about 46 pounds per cubic foot.

12. The web of claim 9, wherein said aluminum oxide particles comprise from about 30% to about 33% of the weight of said web, said web having a density within the range of from about 42 to about 46 pounds per cubic foot.

13. A laminated construction board comprised of a plurality of the webs of claim 9.

14. The web made in accordance with the process of claim 2.

15. The laminated construction board made in accordance with the process of claim 8.

* * * * *